US007910835B2

(12) United States Patent
Baeck et al.

(10) Patent No.: US 7,910,835 B2
(45) **Date of Patent: *Mar. 22, 2011**

(54) COMMUNICATION CABLE OF HIGH CAPACITY

(75) Inventors: Jong-Seb Baeck, Gumi-si (KR); Soo-Gon Ok, Gumi-si (KR)

(73) Assignee: LS Cable Ltd., Anyang-si, Gyeonggi-do (KR)

( * ) Notice: Subject to any disclaimer, the term of this patent is extended or adjusted under 35 U.S.C. 154(b) by 0 days.

This patent is subject to a terminal disclaimer.

(21) Appl. No.: 12/443,779

(22) PCT Filed: Mar. 21, 2008

(86) PCT No.: PCT/KR2008/001588

§ 371 (c)(1), (2), (4) Date: Jul. 10, 2009

(87) PCT Pub. No.: WO2008/143401

PCT Pub. Date: Nov. 27, 2008

(65) Prior Publication Data

US 2009/0308634 A1 Dec. 17, 2009

(30) Foreign Application Priority Data

May 17, 2007 (KR) ..... 10-2007-0048014

(51) Int. Cl.
*H01B 11/02* (2006.01)

(52) U.S. Cl. ..... 174/113 R

(58) Field of Classification Search ..... 174/27, 174/113 R, 113 C

See application file for complete search history.

(56) References Cited

U.S. PATENT DOCUMENTS 7,718,896 B1 * 5/2010 Baeck et al. ..... 174/110 R

FOREIGN PATENT DOCUMENTS

| | | | |
|---|---|---|---|
| JP | 11-053958 | A | 2/1999 |
| JP | 2000-195346 | A | 7/2000 |
| JP | 2003-036739 | A | 2/2003 |
| JP | 2003-109439 | | 4/2003 |
| JP | 2004-362907 | | 12/2004 |
| KR | 10-2002-0044110 | A | 6/2002 |
| KR | 100603087 | B | 2/2006 |
| KR | 10-2007-0023636 | A | 2/2007 |
| KR | 100825408 | B | 4/2008 |

* cited by examiner

*Primary Examiner* — Chau N Nguyen
(74) *Attorney, Agent, or Firm* — Sherr & Vaughn, PLLC

(57) ABSTRACT

In communication cable of high capacity according to present invention, conductor of diameter d is coated by insulation material to form wire of diameter D, plural number of said wire are twisted by pitch p to form pairs, plural number of said pairs are twisted by collective pitch P, and said communication cable of high capacity comprise sheath wrapping said pairs, and impedance (Z) of said wire is from 90 to 110, and, diameter (d) of said conductor is from 0.53 mm to 0.65 mm, and diameter (D) of wire is from 0.9 mm to 1.1 mm, and said pitch (p) is from 8 mm to 25 mm, and said collective pitch (P) is from 40 mm to 150 mm, and relative ratio of diameter of wires to diameter of conductor D/d is from 1.625 to 1.835. And, by impedance matching between equipment for data transmission, return loss of cable can be minimized, so high speed data transmission can be made.

5 Claims, 4 Drawing Sheets

[Fig. 1]
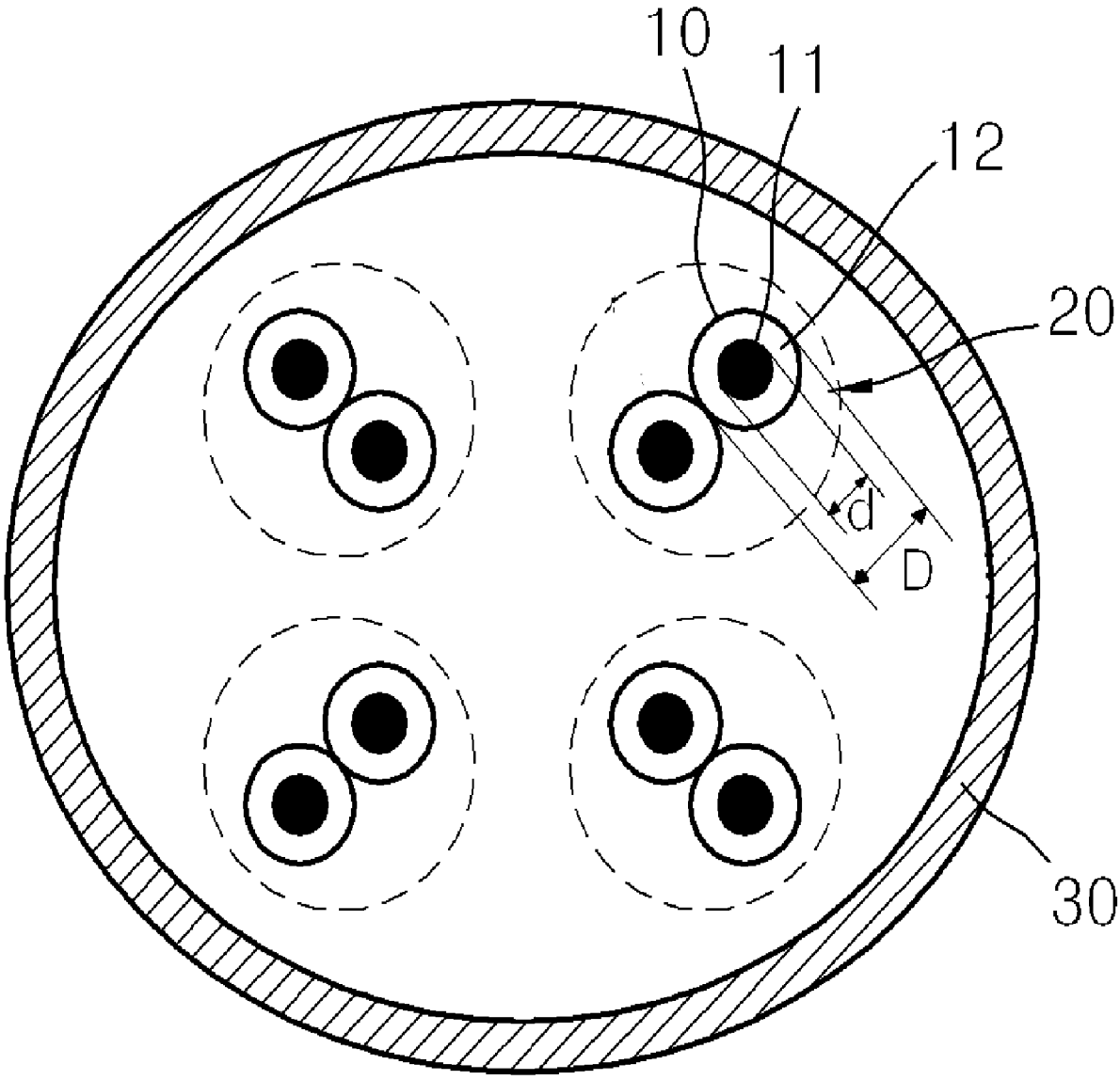

[Fig. 2]
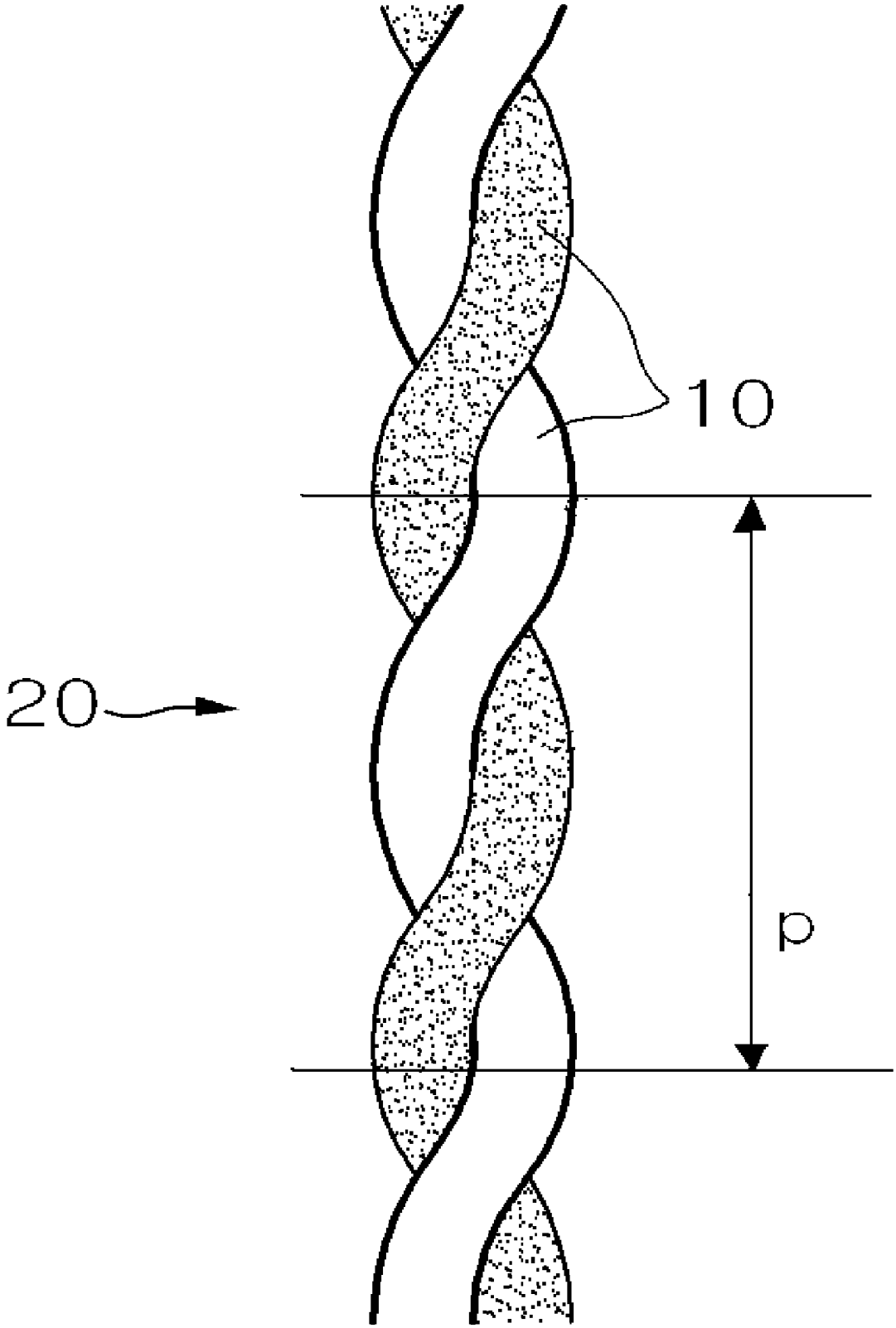

[Fig. 3]
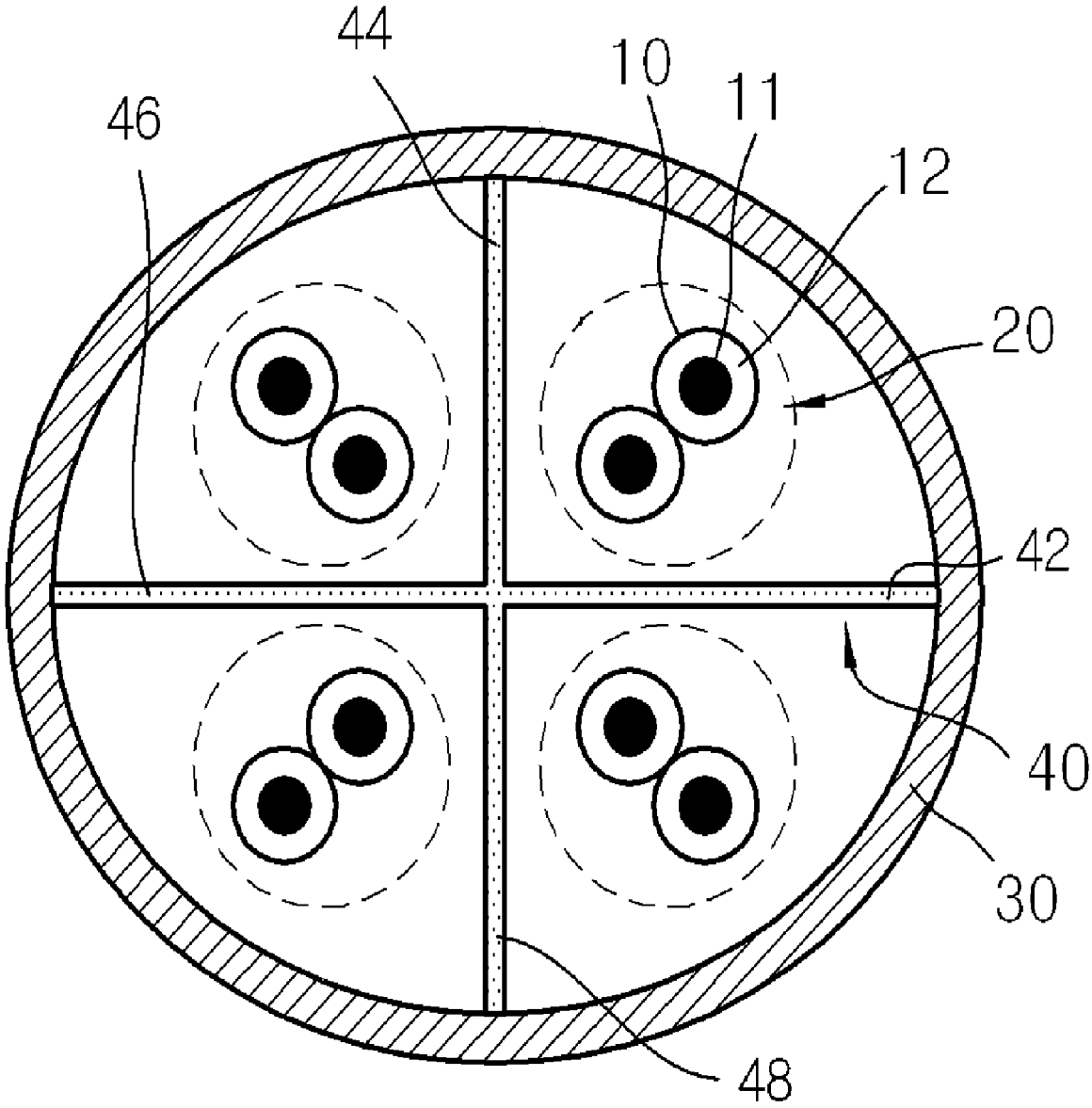

[Fig. 4]

| | Example1 | Example2 | Example3 | Example4 | Example5 | Comparative Example1 | Comparative Example2 | Comparative Example3 | Comparative Example4 | Comparative Example5 | Comparative Example6 |
|---|---|---|---|---|---|---|---|---|---|---|---|
| Diameter of Conductor (d,mm) | 0.56 | 0.56 | 0.64 | 0.56 | 0.60 | 0.56 | 0.56 | 0.50 | 0.69 | 0.56 | 0.53 |
| Diameter of Wire (D1,mm) | 0.99 | 0.99 | 1.05 | 0.91 | 1.10 | 0.8 | 1.2 | 1.2 | 0.85 | 0.85 | 1.15 |
| Diameter of Wire (D2,mm) | 0.99 | 0.97 | 1.05 | 0.91 | 1.10 | 0.8 | 1.2 | 1.5 | 0.75 | 0.83 | 1.17 |
| Diameter of Wire (D3,mm) | 0.99 | 0.98 | 1.10 | 0.91 | 1.10 | 0.8 | 1.2 | 1.2 | 0.80 | 0.84 | 1.16 |
| Diameter of Wire (D4,mm) | 0.99 | 0.96 | 1.10 | 0.91 | 1.10 | 0.8 | 1.2 | 1.5 | 0.70 | 0.82 | 1.17 |
| Pitch of Pair (p1,mm) | 12.0 | 12.0 | 25.0 | 12.0 | 12.0 | 12.0 | 12.0 | 30.0 | 6.0 | 12.0 | 14.0 |
| Pitch of Pair (p2,mm) | 14.0 | 14.0 | 20.0 | 14.0 | 14.0 | 14.0 | 14.0 | 30.0 | 6.0 | 14.0 | 12.0 |
| Pitch of Pair (p3,mm) | 13.0 | 13.0 | 23.0 | 13.0 | 13.0 | 13.0 | 13.0 | 20.0 | 6.0 | 13.0 | 15.0 |
| Pitch of Pair (p4,mm) | 15.0 | 15.0 | 21.0 | 15.0 | 15.0 | 15.0 | 15.0 | 20.0 | 6.0 | 15.0 | 13.0 |
| Collective Pitch (p,mm) | 100 | 100 | 140 | 100 | 100 | 100 | 100 | 160 | 180 | 100 | 90 |
| D1/d | 1.77 | 1.77 | 1.64 | 1.625 | 1.833 | 1.43 | 2.14 | 2.4 | 1.23 | 1.52 | 2.17 |
| D2/d | 1.77 | 1.73 | 1.64 | 1.625 | 1.833 | 1.43 | 2.14 | 3.0 | 1.09 | 1.48 | 2.21 |
| D3/d | 1.77 | 1.75 | 1.72 | 1.625 | 1.833 | 1.43 | 2.14 | 2.4 | 1.16 | 1.5 | 2.19 |
| D4/d | 1.77 | 1.72 | 1.72 | 1.625 | 1.833 | 1.43 | 2.14 | 3.0 | 1.01 | 1.46 | 2.21 |
| Impedance (Z1,ohm) | 101.5 | 101.5 | 99.0 | 93.0 | 105.1 | 78.9 | 119.9 | 137.2 | 57.8 | 85.7 | 121.8 |
| Impedance (Z2,ohm) | 102.3 | 100.3 | 97.3 | 93.7 | 105.9 | 79.7 | 120.7 | 156.9 | 37.0 | 83.9 | 122.6 |
| Impedance (Z3,ohm) | 101.9 | 100.9 | 103.1 | 93.4 | 105.5 | 79.4 | 120.3 | 133.7 | 48.7 | 84.8 | 129.9 |
| Impedance (Z4,ohm) | 102.7 | 99.6 | 102.4 | 94.1 | 106.3 | 80.1 | 121.1 | 153.5 | 17.0 | 82.9 | 123.0 |
| Return Loss in Communication Network (RL margin, dB) | 6.5 | 7.0 | 6.1 | 5.2 | 4.3 | −1.0 | −1.0 | −3.0 | −5.0 | 1.0 | −1.0 |

COMMUNICATION CABLE OF HIGH CAPACITY

CROSS REFERENCE TO PRIOR APPLICATION

The present application is a National Stage Application of PCT International Application No. PCT/KR2008/001588 (filed on Mar. 21, 2008) under 35 U.S.C. §371, which claims priority to Korean Patent Application No. 10-2007-0048014 (filed on May 17, 2007), which is hereby incorporated by reference in its entirety.

TECHNICAL FIELD

The present invention relates to communication cable of high capacity, more specifically communication cable of high capacity which has impedance value enabling high speed transmission and lower return loss and high productivity.

BACKGROUND ART

As information technology like ATM and Ethernet or the like develops recently, communication cable appears to be more important.

Generally, UTP (Unshielded Twisted Pair) cable which is used for communication cable is fabricated in the following steps: electric wires consist of conductor such as copper or etc. coated by insulation coating are twisted to form twisted pairs, then four twisted pairs are collected and coated by insulation coating.

It has been desired to increase the information transmitting capacity of the communication cable, and the communication cable has been developed to increase its information transmitting capacity.

In the meanwhile, the communication cable are classified by the identification characters such as category (or Cat.) and number in accordance with its signal transmitting capacity under international agreement, wherein the bigger number means the higher transmitting capacity.

For example, communication of Cat.3 can transmit signal of 16 MHz, Cat.4 can 20 MHz, and Cat.5 can 100 MHz, wherein the higher modulation frequency is used, the more informations can be transmitted.

However, as the higher modulation frequency is used, the noise due to the cross talk among the cables and change of the impedance in the conducting wires is increased, which results in a problem that the assortment of the signals gets more difficult in the signal receiver.

For this reason, up to recently, the limit of the UTP cable's signal transmitting capacity has been seemed to be around 155 Mbps (Megabit per sec).

However, as the technology of information transmitting equipment develops recently, the signal worsening due to the cross talk in the cable can be compensated by way of compensation method using DSP (digital signal processing) equipment and etc, so it is possible to transmit 1,000 Mbps (1 Gbps) using Cat.5e, and the standard committee of IEEE (Institute of Electrical and Electronics Engineers) officially decided 1000 Base-T as the standard of Ethernet in the year of 1999.

In the meanwhile, in view of the developing trend of the related technology such as movie transmission technology and etc, the cable which can transmit information in a higher level will be needed in the near future, so that major cable manufacturers and related system manufacturers are competitively investing for satisfying this need, and also in the IEEE a specialized committee is organized for standardization on high speed information transmission cable.

However, for improvement of the transmission capacity, usually higher frequency is used, and that results in problems of proportional increase of insertion loss, impedance mismatching between electric wire and equipment, cross talk between wires.

Representative cross talk are RL (Return Loss), NEXT (Near End Cross Talk), FEXT (Far End Cross Talk) and etc, to solve these, compensation in transmission system and change of pitch, diameter of conductor, diameter of wire, shape of cross filler has been tried.

Overviewing patents related to improvement of UTP cable's transmission capacity, cross talk between wires has been seemed to be important factor for worsening of transmission quality, a lot of effort has been done to solve said problem.

Related important patents are U.S. Pat. No. 5,132,488, U.S. Pat. No. 5,969,295, U.S. Pat. No. 5,519,173, U.S. Pat. No. 5,952,615 etc, to overviewing the contents, to improve transmission capacity those present positioning metal foil in sheath, constraining cross talk by inserting filler.

Moreover, recently useful band of frequency is expanded to at least 400 MHz, particularly 500-650 MHz, band of high frequency is used for high transmission capacity more than 20 Gbps in theoretical transmission capacity (Shannon Capacity), in practical transmission capacity 10 Gbps.

In case of using band of high frequency, it is important problem to minimize noise in cable by matching impedance of wire in cable to international standard of 100 ohm around so matching impedance between cable and equipment.

DISCLOSURE OF INVENTION

Technical Problem

Accordingly, the purpose of the present invention is to solve above-described problems, and is to provide communication cable with impedance value enabling high speed transmission of data.

Another purpose of the present invention is to provide communication cable with impedance value around 100 ohm and enabling decreasing return loss.

Another purpose of the present invention is to provide communication cable with high productivity, and impedance value and return loss enabling high speed transmission of data.

Technical Solution

To achieve said object, in communication cable of high capacity according to present invention, conductor of diameter d is coated by insulation material to form wire of diameter D, plural number of wires are twisted by pitch p to form pairs, plural number of said pairs are twisted by collective pitch P, and said communication cable of high capacity comprise sheath wrapping said pairs. and the impedance (Z) of said wire is from 90 to 110, and diameter (d) of said conductor is from 0.53 mm to 0.65 mm, and diameter (D) of said wire is from 0.9 mm to 1.1 mm, and pitches of said pairs are from 8 mm to 25 mm, and said collective pitch is from 40 mm to 150 mm, and D/d is from 1.625 to 1.835.

Here, pitches (p) of said plural pairs are different from one another.

Preferably, the relationship between pitches (p) of said plural pairs and diameters (D) of said wires are, if $p_1$ is larger than $p_2$ ($p_1 > p_2$), then $D_2$ is larger than $D_1$ ($D_1 < D_2$).

And, said communication cable further comprises separator for separating said plural pairs.

Here, said separator has cross section of cross shape.

Advantageous Effects

By the present invention, communication cable with impedance value enabling high speed transmission of data can be constituted.

And, communication cable with impedance value around 100 ohm and enabling decreasing return loss can be constituted.

And, communication cable with high productivity, and impedance value and return loss enabling high speed transmission of data can be constituted.

BRIEF DESCRIPTION OF THE DRAWINGS

The drawings attached illustrate the preferable embodiment of the present invention, only helps further understanding of the idea of the present invention along with the detailed description of the present invention described in the below, and thus the present invention is not limitedly interpreted to the matters shown in the drawings.

FIG. 1 is cross sectional view of communication cable according to present invention.

FIG. 2 is plane view of pairs (20) in communication cable according to present invention.

FIG. 3 cross sectional view of communication cable according to example of present invention which comprise separator.

FIG. 4 is chart showing characteristic value of communication cable according to example of present invention and comparative example.

MODE FOR THE INVENTION

Hereinafter, the present invention is described in detail with reference to the attached drawings.

Before the detailed description, it should be noted that the terms used in the present specification and the claims are not to be limited to their lexical meanings, but are to be interpreted to conform with the technical idea of the present invention under the principle that the inventor can properly define the terms for the best description of the invention made by the inventor.

Therefore, the embodiments and the constitution illustrated in the attached drawings are merely preferable embodiments according to the present invention, and thus they do not express all of the technical idea of the present invention, so that it should be understood that various equivalents and modifications can exist which can replace the embodiments described in the time of the application.

FIG. 1 is cross sectional view of communication cable according to present invention, and FIG. 2 is plane view of pairs (20) in communication cable according to present invention.

Referring to FIG. 1 and FIG. 2, communication cable according to present invention comprises wire (10) which is constituted by conductor (11) coated by insulation material (12) and pairs (20) which is constituted by twisting said wires (10) and sheath (30) wrapping said pairs (20).

Here, said electric wires (11) with diameter D are formed by straight conductor (11) with diameter d such as copper coated by insulation member (12) to transmit data transformed into electric signal.

Said insulation member (12) are formed by high molecular resin LDPE (Low Density Polyethylene), HDPE (High Density Polyethylene), FEP (Fluorinated Ethylene Propylene), etc which has low dielectric constant and are easy to handle.

Said pairs (20) are formed by twisting the electric wires (10) by constant pitch (p), generally as seen in FIG. 1, two electric wires are twisted, but not limited to this and various modifications can be done.

And, the pairs (20) can be coated on its outer surface of the electric wires (10) to improve transmitting characteristic by decreasing signal interference by shielding electromagnetic wave.

The pairs (20) are comprised in the communication cable of high capacity at least two, generally as seen in FIG. 1, four pairs (14) are comprised in the sheath (30), not limited to this and various modifications can be done.

In the meanwhile, to restrain the interference between each pairs (20) in the cable, the pairs are twisted by different pitch (p) from one another, preferably by different pitch range of 0.5~10 mm.

The total pairs (20) are twisted by constant pitch, and this twisted pitch of total pairs (20) is called "collective pitch" P.

And, the cable comprises sheath (30) to form external appearance wrapping the twisted total pairs (20).

Here, the sheath (30) protect the pairs (20) mechanically and shielding alien cross talk generated by electromagnetic wave from adjacent other cable or electric equipment.

Generally, the sheath (30) is formed by insulation material such as high molecular resin for example, polyethylene, PVC, or Olefin system and preferably by 0.3~1.5 mm thickness.

Because, if the thickness of the sheath (30) is under 0.3 mm, the electric wires (10) can not be protected from the alien crosstalk, and the thickness is over 1.5 mm, the weight of the cable is increased by the thickness and the flexibility of the cable is decreased.

Preferably, to improve the alien crosstalk shielding effect, electromagnetic wave shielding sheath (not illustrated) formed by conductive material can be comprised in the sheath (30).

Communication cable of high capacity according to present invention comprise said elements, and to form communication cable which is proper to high speed transmission, impedance of wires (10) in cable and impedance of equipment are matched for high speed transmission of data, so return loss of cable can be minimized.

So, to calculate the impedance of wires (10) in the cable following numerical formula is useful.

$$Z = \sqrt{\frac{R + i\omega L}{G + i\omega C}} \tag{1}$$

Here, R, L, G are resistance (R), inductance (L), conductance (G), capacitance (C) of wire (10) in cable.

Accordingly, to calculate impedance (Z) of said formula (1), at first resistance (R), inductance (L), conductance (G), capacitance (C) should be calculated, about wire (10) in FIG. 1 comprising conductor (11) and insulation member (12), said values can be calculated by following numerical formula.

$$R = \frac{2\sqrt{\frac{\pi f \mu_c}{\sigma_c}}}{\pi r}\left[\frac{\frac{D}{d}}{\sqrt{\left(\frac{D}{d}\right)^2 - 1}}\right](\Omega/m) \quad (2)$$

$$L = \frac{\mu_0 \mu_r}{\pi}\cosh^{-1}\left(\frac{D}{d}\right)(H/m) \quad (3)$$

$$G = \frac{\pi\sigma}{\cosh^{-1}\left(\frac{D}{d}\right)}(S/m) \quad (4)$$

$$C = \frac{\pi\varepsilon_0\varepsilon_r}{\cosh^{-1}\left(\frac{D}{d}\right)}(F/m) \quad (5)$$

Here, $\in_0\in_r$ is dielectric constant of insulation member (12)($\in_0$: dielectric constant at vacuum state, $\in_r$: relative dielectric constant), $\mu_0\mu_r$ is magnetic permeability constant of conductor (11) ($\mu_0$: magnetic permeability constant at vacuum state, $\mu_r$: relative magnetic permeability constant), $\sigma$ is dielectric loss ratio constant.

If input said formula (2), (3), (4), (5) which is represented by $$\left(\frac{D}{d}\right)$$

into formula (1), it should be understandable that impedance of wire (10) comprising conductor (11) and insulation member (12) is determined by diameter of conductor (d) and diameter of wire (10)(D).

That is, by said numerical formulas, according to matching impedance diameter of conductor (d) and diameter of wire (D) can be determined.

But, in case of forming cable which has conductor of diameter (d) and diameter of wire (D) with matching impedance by said formulas, real impedance has difference with theoretical impedance.

Said difference comes from error in dielectric ($\in_0\in_r$) error and design error such as pitch (p), collective pitch (P) etc.

Here, about said error in dielectric constant ($\in_0\in_r$) error, generally insulation member (12) such as HDPE (High Density Polyethylene), FEP etc has dielectric constant from 2.1 to 2.3 and dielectric constant of air is 1, said dielectric constant from said conductors (11) effect from dielectric of said insulation member and air complexly, so said dielectric constant can not be define exactly.

And, said design error result from length increasing rate by twisting wires to form cable by pitch (p) and collective pitch (P).

In the meanwhile, capacitance value is inverse proportional to distance between wires and proportional to size of cross section of wires, increase/decrease of said length increasing rate by twisting wires by pitch (p) and collective pitch (P) make size of cross section of wires increase/decrease in specific area so it effects the capacitance value and varies the impedance value (Z).

Accordingly, cable according to present invention introduce compensation factor to compensate said errors, and by said formulas following formula can be resulted.

$$Z = A \times \ln\left[\left(\frac{D}{d} + \sqrt{\left(\frac{D}{d}\right)^2 - 1}\right) \times \left(1 + B \times \frac{P \times p}{P + p}\right)\right] \quad (6)$$

Here, compensation coefficient A is by dielectric constant of insulation member (12) ($\in_0\in_r$), magnetic permeability of conductor ($\mu_0\mu_r$), skin effect, proximity effect, and is from 81 to 83.

And, compensation coefficient B is by length increasing rate resulted from capacitance compensated by pitch, collective pitch, and is from 0.005 to 0.007.

Here, calculation formula for said compensation coefficient A, B is as followings, and a, b is constant.

$$A = a \times \frac{\mu_0\mu_r + \pi f}{\varepsilon_0\varepsilon_r + \sigma}, \quad B = b \times \sqrt{1 + \left(\frac{\pi D}{p}\right)^2} \quad (7)$$

By geometric structure of cable exact dielectric constant and magnetic permeability can not be calculated.

But, based on values from experiment and effect from dielectric constant, magnetic permeability, surface resistance, high frequency wave, length increasing rate, by said formula (7), a, b and A, B were obtained.

Here, said impedance is formed to have range from 90Ω to 110Ω for conforming Cat.6 or Cat.6A which are standard of UTP cable.

Therefore, by said formula (6), impedance of said cable can be calculated by pitch (p) and relative ratio of diameter of wires (10)(D) to diameter of conductor (d) D/d, and to have impedance range from 90Ω to 110Ω, said pitch (p) is from 8 mm to 25 mm, and said collective pitch (P) is from 40 mm to 150 mm, and said relative ratio of diameter of wires to diameter of conductor D/d is from 1.625 to 1.835.

And, diameter (d) of said conductor is formed to have range from 0.53 mm to 0.65 mm, and diameter (D) of said wire is from 0.9 mm to 1.1 mm.

Here, said pitch is formed to have range from 8 mm to 25 mm, and if said pitch (p) is under 8 mm, total length of wires (11) are increased by short pitch, so material consumption and transmission loss of data increase, if said pitch (p) is over 25 mm, structure is not stable so it is difficult to keep the structure of pairs (20).

And, relative ratio of diameter of wires (10)(D) to diameter of conductor (d) D/d is formed to have range from 1.625 to 1.835, and if said ratio is under 1.625, thickness of insulation member decrease excessively, so sufficient shielding effect can not be provided, and if said ratio is over 1.835 material consumption increases by increased diameter of cable and flexibility of cable decrease so it makes installation of cable difficult.

As mentioned before, diameter (d) of said conductor is formed to have from 0.53 mm to 0.65 mm, if diameter (d) of conductor is under 0.53 mm, by increased resistance of conductor (11), attenuation characteristic falls down, so bad effect can be occurred to high speed data transmission, and if diameter (d) of conductor is over 0.65 mm, material consumption increases and flexibility of cable decrease.

In this case, by range of said relative ratio of diameter of wires (10)(D) to diameter of conductor (d) D/d, diameter (D) of wire is from 0.9 mm to 1.1 mm.

And, the range of collective pitch (P) can be set up by pitch (p), ratio of diameter D/d, and numerical formula (6), and the range of collective pitch (P) is from 40 mm to 150 mm.

Cable according to present invention which has said range of diameter (d) of conductor, diameter (D) of wire, pitch (p) and collective pitch (P), by said formula (6), said pitch (p) and diameter (D) of wire are inverse proportional to each other.

That is, about specific impedance (Z) and diameter (d) of conductor, if diameter (D) of wire decreases, then, $$\left(\frac{P \times p}{P + p}\right)$$

increases, and generally collective pitch (P) is bigger than pitch (p), P⟩p, so, to be grow bigger said value of $$\left(\frac{P \times p}{P + p}\right)$$

, then p must approach to P, so consequently p must be bigger.

Accordingly, in case said pitches (p) are different in every pair (20), said diameter (D) of wire can be different in every pair (20), in this case if said pitch (p) increase, then diameter (D) of wire is formed to be decreased.

That is, about pitch, if p1⟩p2, diameter (D) of wires which have pitch p1, p2 are formed to have D1⟨D2.

FIG. 3 cross sectional view of communication cable according to one example of present invention which comprise separator (40) to separate said plural pairs (20) from one another.

Referring to FIG. 3, to prevent cross talk among said plural pairs (20), said separator (40) comprises cross separation walls (42, 44, 46, 48) to separate said pairs (20).

Here, said separator (40) is formed to have helical structure and same pitch with said collective pitch (P) for said plural pairs (20) being twisted forming collective pitch (P).

And, said separator (40) can be form in various structure according to the number of said pairs (20) to separate the same, in case said pairs (20) is four, preferably as seen in FIG. 3, the separator (40) can be formed to have cross structure.

By said cross structure, it can widen distance between each pairs (20), so can suppress interference between pairs (20).

FIG. 4 is chart showing characteristic value of communication cable according to example of present invention and comparative example.

Referring to FIG. 4, communication cable according to example of present invention which has conductor of diameter d, wire diameter of D, pitch p, collective pitch P and comparative example are compared with each other.

First Example

In communication cable according to first example of present invention, two wires (11) of diameter D which have conductor (11) of diameter d are twisted with each other by pitch p to form pair (20), and four pairs are twisted helically by collective pitch P.

In said first example, diameter d of conductor is 0.56 mm, diameter D of wire is 0.99 mm, pitches p are 12.0 mm, 14.0 mm, 13.0 mm, 15.0 mm respectively, and collective pitch P is 100 mm.

In said first example of communication cable, D/d is 1.77, and this value is comprised in the range from 1.625 to 1.835.

In the meanwhile, measuring impedance of said communication cable according to first example of present invention, each pair (20) had 101.5Ω, 102.3Ω, 101.9Ω, 102.7Ω respectively.

Said impedance is near 100Ω which is suggested by IEEE 802.3 committee and is matching impedance of Cat.6, Cat.6A which enable 10 Gbps rate data transmission, and that means communication cable most suitable for data transmission.

And, return loss in network of communication cable according to first example of present invention was 6.5 dB which is excellent.

Referring to FIG. 4, conventional cable is shown in comparative example 1 compared with communication cable according to first example of present invention, and in comparative example 1, diameter of conductor d is 0.56 mm, diameter of wire D is 0.8 mm, pitches p are 12.0 mm, 14.0 mm, 13.0 mm, 15.0 mm respectively, and collective pitch P is 100 mm.

In this case, measuring impedance of said communication cable according to comparative example, each pair (20) had 78.9Ω, 79.7Ω, 79.4Ω, 80.1Ω respectively, and these have difference with matching impedance 100Ω of Cat.6, Cat.6A.

And, return loss in network of communication cable according to first comparative example was −1.0 dB which is inferior to first example of present invention.

Second Example

In communication cable according to second example of present invention, two wires (11) of diameter D which have conductor (11) of diameter d are twisted with each other by pitch p to form pair (20), and four pairs are twisted helically by collective pitch P.

In said second example, diameter d of conductor is 0.56 mm, diameter D of wire is 0.99 mm, 0.97 mm, 0.98 mm, 0.96 mm respectively, and pitches p are 12.0 mm, 14.0 mm, 13.0 mm, 15.0 mm respectively, and collective pitch P is 100 mm.

In said second example of communication cable, D/d are 1.77, 1.73, 1.75, 1.72 respectively, and these values are comprised in the range from 1.625 to 1.835.

In the meanwhile, measuring impedance of said communication cable according to second example of present invention, each pair (20) had 101.5Ω, 100.3Ω, 100.9Ω, 99.6Ω respectively.

Said impedance is near 100Ω which is suggested by IEEE 802.3 committee and is matching impedance of Cat.6, Cat.6A which enable 10 Gbps rate data transmission, and that means communication cable most suitable for data transmission.

And, return loss in network of communication cable according to second example of present invention was 7.0 dB which is excellent.

Referring to FIG. 4, conventional cable is shown in comparative example 2, comparative example 3 compared with communication cable according to second example of present invention, and in comparative example 2, diameter of conductor d is 0.56 mm, diameter of wire D is 1.2 mm, pitches p are 12.0 mm, 14.0 mm, 13.0 mm, 15.0 mm respectively, and collective pitch P is 100 mm.

In this case, measuring impedance of said communication cable according to comparative example 2, each pair (20) had 19.9Ω, 120.7Ω, 120.3Ω, 121.1Ω respectively, and these have difference with matching impedance 100Ω of Cat.6, Cat.6A.

And, in comparative example 3, diameter of conductor d is 0.50 mm, diameter of wire D is 1.2 mm, 1.5 mm, 1.2 mm, 1.5 mm, pitches p are 30.0 mm, 30.0 mm, 20.0 mm, 20.0 mm respectively, and collective pitch P is 160 mm.

In this case, measuring impedance of said communication cable according to comparative example 3, each pair (20) had 137.2Ω, 156.9Ω, 133.7Ω, 153.5Ω respectively, and these have difference with matching impedance 100Ω of Cat.6, Cat.6A.

And, return loss in network of communication cable according to second comparative example and third comparative example were −1.0 dB, −3.0 dB which are inferior to second example of present invention.

Third Example

In communication cable according to third example of present invention, two wires (10) of diameter D which have conductor (11) of diameter d are twisted with each other by pitch p to form pair (20), and four pairs are twisted helically by collective pitch P.

In said third example, diameter d of conductor is 0.64 mm, diameters D of wires are 1.05 mm, 1.05 mm, 1.10 mm, 1.10 mm, pitches p are 25.0 mm, 20.0 mm, 23.0 mm, 21.0 mm respectively, and collective pitch P is 140 mm.

In said third example of communication cable, D/d are 1.64, 1.64, 1.72, 1.72 respectively and this values are comprised in the range from 1.625 to 1.835.

In the meanwhile, measuring impedance of said communication cable according to third example of present invention, each pair (20) had 99.0Ω, 97.3Ω, 103.1Ω, 102.4Ωrespectively.

Said impedance is near 100Ω which is suggested by IEEE 802.3 committee and is matching impedance of Cat.6, Cat.6A which enable 10 Gbps rate data transmission, and that means communication cable most suitable for data transmission.

And, return loss in network of communication cable according to third example of present invention was 6.1 dB which is excellent.

Referring to FIG. 4, conventional cable is shown in comparative example 4 compared with communication cable according to third example of present invention, and in comparative example 4, diameter of conductor d is 0.69 mm, diameters of wires D are 0.85 mm, 0.75 mm, 0.80 mm, 0.70 mm respectively, pitch p is 6.0 mm, and collective pitch P is 180 mm.

In this case, measuring impedance of said communication cable according to comparative example 4, each pair (20) had 57.8Ω, 37.0Ω, 48.7Ω, 17.0Ω respectively, and these have difference with matching impedance 100Ω of Cat.6, Cat.6A.

And, return loss in network of communication cable according to comparative example 4 was −5.0 dB which is inferior to third example of present invention.

Fourth Example

In communication cable according to fourth example of present invention, two wires (10) of diameter D which have conductor (11) of diameter d are twisted with each other by pitch p to form pair (20), and four pairs are twisted helically by collective pitch P.

In said fourth example, diameter d of conductor is 0.56 mm, diameter D of wire is 0.91 mm, pitches p are 12.0 mm, 14.0 mm, 13.0 mm, 15.0 mm respectively, and collective pitch P is 100 mm.

In said fourth example of communication cable, D/d are 1.625 and this value is comprised in the range from 1.625 to 1.835.

In the meanwhile, measuring impedance of said communication cable according to fourth example of present invention, each pair (20) had 93.0Ω, 93.7Ω, 93.4Ω, 94.1Ω respectively.

Said impedance is near 100Ω which is suggested by IEEE 802.3 committee and is matching impedance of Cat.6, Cat.6A which enable 10 Gbps rate data transmission, and that means communication cable most suitable for data transmission.

And, return loss in network of communication cable according to fourth example of present invention was 5.2 dB which is excellent.

Referring to FIG. 4, conventional cable is shown in comparative example 5 compared with communication cable according to fourth example of present invention, and in comparative example 5, diameter of conductor d is 0.56 mm, diameters of wires D are 0.85 mm, 0.83 mm, 0.84 mm, 0.82 mm respectively, pitches p are 12.0 mm, 14.0 mm, 13.0 mm, 15.0 mm respectively, and collective pitch P is 100 mm.

In this case, measuring impedance of said communication cable according to comparative example 5, each pair (20) had 85.7Ω, 83.9Ω, 84.8Ω, 82.9Ω respectively, and these approach to 100Ω more than other comparative examples but have difference with matching impedance 100Ω compared with examples of present invention.

And, return loss in network of communication cable according to comparative example 5 was 1.0 dB which is superior than other comparative examples but inferior to other examples of present invention.

Fifth Example

In communication cable according to fifth example of present invention, two wires (10) of diameter D which have conductor (11) of diameter d are twisted with each other by pitch p to form pair (20), and four pairs are twisted helically by collective pitch P.

In said fifth example, diameter d of conductor is 0.60 mm, diameter D of wire is 1.10 mm, pitches p are 12.0 mm, 14.0 mm, 13.0 mm, 15.0 mm respectively, and collective pitch P is 100 mm.

In said fifth example of communication cable, D/d is 1.833 and this value is comprised in the range from 1.625 to 1.835.

In the meanwhile, measuring impedance of said communication cable according to fifth example of present invention, each pair (20) had 105.1Ω, 105.9Ω, 105.5Ω, 106.3Ωrespectively.

Said impedance is near 100Ω which is suggested by IEEE 802.3 committee and is matching impedance of Cat.6, Cat.6A which enable 10 Gbps rate data transmission, and that means communication cable most suitable for data transmission.

And, return loss in network of communication cable according to fifth example of present invention was 4.3 dB which is excellent.

Referring to FIG. 4, conventional cable is shown in comparative example 6 compared with communication cable according to fifth example of present invention, and in comparative example 6, diameter of conductor d is 0.53 mm, diameters of wires D are 1.15 mm, 1.17 mm, 1.16 mm, 1.17 mm respectively, pitches p are 14.0 mm, 12.0 mm, 15.0 mm, 13.0 mm respectively, and collective pitch P is 90 mm.

In this case, measuring impedance of said communication cable according to comparative example 6, each pair (20) had 121.8Ω, 122.6Ω, 129.9Ω, 123.0Ω respectively, and these have difference with matching impedance 100Ω of Cat.6, Cat.6A.

And, return loss in network of communication cable according to comparative example 6 was −1.0 dB which is inferior to fifth example of present invention.

As described above, first to fifth examples of communication cable according to present invention have nearer impedance characteristic to 100Ω which enable 10 Gbps data transmission than conventional comparative examples 1 to 6, and shows superior network characteristic to the same.

Although the present invention has been described with reference to the specified examples in the above, but the idea of the present invention is not limited to the above described matters and various changes and modifications can be made within the equivalent scope of the present invention and the following claims by the ordinary-skilled person of the art.

The invention claimed is:

1. In communication cable of high capacity, conductor of diameter d is coated by insulation material to form wire of diameter D, plural number of wires are twisted by pitch p to form pairs, plural number of said pairs are twisted by collective pitch P, wherein, said communication cable of high capacity comprise sheath wrapping said pairs, the impedance (Z) of said wire is from 90 to 110, diameter (d) of said conductor is from 0.53 mm to 0.65 mm, diameter (D) of said wire is from 0.9 mm to 1.1 mm, pitches (p) of said pairs are from 8 mm to 25 mm, collective pitch (P) is from 40 to 150 mm, relative ratio of diameter of wires to diameter of conductor D/d is from 1.625 to 1.835.

2. Communication cable of high capacity according to claim 1, wherein, pitches (p) of said plural pairs are different from one another.

3. Communication cable of high capacity according to claim 2, wherein, the relationship between pitches (p) of said plural pairs and diameters (D) of said wires are, if pitch of one pair is larger than pitch of another pair, diameter of wire in the pair that has larger pitch is smaller than diameter of wire in the pair that has smaller pitch.

4. Communication cable of high capacity according to one of claims 1 to 3, wherein, said communication cable further comprises separator for separating said plural pairs.

5. Communication cable of high capacity according to claim 4, wherein, said separator has cross section of cross shape.

* * * * *